United States Patent [19]

Haltof et al.

[11] Patent Number: 4,763,447

[45] Date of Patent: Aug. 16, 1988

[54] TORQUE ACTUATED BRAKE MECHANISM FOR SPRING BALANCED WINDOW SASH

[75] Inventors: Garry P. Haltof, Rochester, N.Y.; Earl L. Dodson, Elliston, Va.

[73] Assignee: American Balance Corporation, Roanoke, Va.

[21] Appl. No.: 52,430

[22] Filed: May 21, 1987

[51] Int. Cl.[4] ..... E05F 3/00

[52] U.S. Cl. ..... 49/429; 49/445

[58] Field of Search ..... 49/445, 446, 429, 430

[56] References Cited

U.S. PATENT DOCUMENTS

| | | | |
|---|---|---|---|
| 2,903,736 | 9/1959 | Osten, Sr. | 49/446 X |
| 4,570,382 | 2/1986 | Suess | 49/445 X |
| 4,571,887 | 2/1986 | Haltof | 49/429 |

*Primary Examiner*—Philip C. Kannan

*Attorney, Agent, or Firm*—Staas & Halsey

[57] ABSTRACT

A brake mechanism utilizes the tension of a spring acting upwardly and the weight of a window acting downwardly to produce a force couple for applying a frictional force to hold a window sash in a preselected position in a sash run. The mechanism is utilized in combination with a jamb liner defining an elongated sash run provided with a C-shaped guide channel in its plow region. The channel has co-planar, laterally spaced, flanges defining a longitudinally extending slot therebetween. A brake component has a pair of shoe portions disposed in the channel adjacent respective internal flange surfaces. The brake component rotates in the channel to move the shoe portions into frictional engagement with the internal flange surfaces. A columnar element rigid with the brake component extends through the slot and presents means disposed outside the channel for applying a torque to rotate the brake component inside the channel. A support platform for a window sash and a balance spring are connected to respective spaced points on the columnar element outside the channel. The connection points are offset so that the tension of the spring acting upwardly and the weight of the sash acting downwardly impose a torque on the element to rotate the brake component and move the brake shoe elements into frictional contact with the internal flange surfaces.

13 Claims, 2 Drawing Sheets

TORQUE ACTUATED BRAKE MECHANISM FOR SPRING BALANCED WINDOW SASH

BACKGROUND OF THE INVENTION

1. Field of the Invention

The present invention relates to brake mechanisms for applying sliding friction to retard movement of spring balanced window sashes running in vertical sash runs. In particular, the invention relates to such mechanisms which utilize the tension of the spring acting upwardly and the weight of the window acting downwardly to produce a frictional force to assist in holding the window sash in a selected position in a vertical sash run.

2. The Prior Art

A basic problem which has been encountered in connection with spring balanced window sash mechanisms in the past is that a frictional force is sometimes needed to hold the sash in a desired position in a vertical sash run. When the sash is pushed downwardly, gravity assists the operation so that frictional forces may easily be overcome. However, particularly when it is desired to raise the sash, the operation is facilitated if such frictional forces may be diminished. Theoretically, a properly selected balance spring may exactly balance the weight of the sash at a particular, singular vertical position; however, such positioning seldom is encountered in actual practice. Accordingly, a friction brake capable of applying sufficient friction to hold the sash in all vertical positions and yet capable also of permitting movement of the sash during opening and/or closing operations has been sought. From a practical viewpoint, there has been a need for such a brake device which is capable of applying the required frictional force generally uniformly so as to prevent excessive forces and the resultant jamming and distortion of the braking and guidance mechanism.

A previous device which has found some use in the field is described in U.S. Pat. No. 4,571,887. The device disclosed in this prior patent incorporates interferring wedges which travel together in a guide channel and which move relatively to apply friction by forcing the walls of the channel apart. However, such devices often malfunction because the friction between the wedging surfaces of the relatively movable elements of the interferring wedge of the '887 device inherently inhibits relative movement of the wedging elements in a direction to effect release of the brake, particularly when upward movement of the sash is desired.

A previous improvement directed to avoiding the problems of the prior art and particularly the problems encountered in connection with the '887 device is disclosed in co-pending application Ser. No. 881,927, filed Jul. 3, 1986 and assigned to the assignee of the present application. The device of the '927 application solves many of the problems encountered in prior art devices; however, this device consisted of a number of intricate parts and is complicated in its manufacture and installation. Unlike the device of the '887 patent, which operates on the principle of a drum brake, the device of the '927 application operates on the principle of a disc brake.

Each of the prior art devices described above have utilized a pair of relatively vertically movable elements to create laterally directed frictional forces which were utilized to retard movement of the sash and assist in holding the same in a selected position in the vertical sash run.

SUMMARY OF THE INVENTION

The present invention provides an exceeding simple construction which avoids many, if not all, of the aforementioned problems inherent in the prior art devices. In its broadest application, the device of the present invention simply incorporates a rotatable brake shoe component which is rotatable in a direction for moving a brake shoe portion thereof into frictional engagement with a braking surface in a sash run. The brake component is rotated by application of a torque resulting from a force couple produced by the tension of the spring acting upwardly and the weight of the window acting downwardly. With such operation, a single brake component may be utilized to produce the required braking friction.

The present invention provides a brake mechanism for applying sliding friction to retard movement of a spring balanced window sash running in a vertical sash run provided with a vertically extending braking surface. The mechanism comprises a brake component having a brake shoe portion adapted for movement along the braking surface as the sash moves vertically in the run. The brake component is rotatable in a direction for moving the brake shoe portion into frictional engagement with the braking surface. The mechanism also includes force couple means operably coupled with the brake component and adapted to be operably connected between a balance spring and the window sash for converting the tension of the spring acting upwardly and the weight of the window acting downwardly into a torque acting on the component for rotating the latter in the direction for moving the brake shoe portion into frictional engagement with the braking surface.

The force couple means may comprise a columnar element that is rigid with the brake component and which has spaced points of connection thereon for load bearing connection to the spring and to the sash respectively. The brake shoe portion may be configured for running inside a guide channel with the braking surface comprising an inner surface of the channel. Ideally, the brake mechanism may include a pair of spaced brake shoe portions configured for running inside a generally C-shaped guide channel which presents a pair of horizontally spaced, vertically extending braking surfaces defining a vertical slot therebetween, the arrangement being such that the brake shoe portions interact with respective corresponding surfaces. The columnar element is configured to extend through the slot so that the points of connection thereon are disposed of externally of the guide channel.

More specifically, the mechanism may include a support component comprising a platform for the sash and means for mounting the support component on the columnar element at the corresponding connection point thereon. Even more preferably, the mounting means may include structure capable of providing freedom for rotational movement of the platform relative to the columnar element about two generally perpendicular, generally horizontal axes. The brake mechanism may also include connector means for connecting the spring to its corresponding point of connection on the columnar element.

In a particularly preferred form of the invention, the mechanism may include an elongated stabilizer element for interconnecting the spring and its corresponding connection point on the columnar element. Such stabilizer element is operable to inhibit lateral displacement of the spring during operation of the brake component. In its preferred form, the stabilizer element may have a spring attaching means at one end thereof and a connector means at its other end configured for connection to the connection point for the spring on the columnar element.

In specific detail, in the particularly preferred arrangement of the brake mechanism of the present invention, the guide channel has a pair of horizontally spaced, longitudinally extending outer surfaces disposed on respective opposite sides of the slot. In this preferred embodiment, the mechanism may include a generally planar, elongated stabilizer element for interconnecting the spring and its corresponding connection point on the columnar element. The stabilizer element may be configured to span the slot and slide along the outer surfaces of the channel during operation of the mechanism, whereby lateral displacement of the spring when the brake component rotates is inhibited. In another important aspect of the invention, the stabilizer element may include a tongue portion which protrudes through the slot and into the channel between the surfaces. The tongue portion may have a lateral dimension which is slightly less than the width of the slot to thereby further inhibit lateral movement of the element in the direction across the slot.

In a more general aspect of the invention, a composite jamb liner and balance spring assembly is provided. The assembly comprises means defining an elongated sash run having a longitudinally extending, generally C-shaped guide channel disposed in the sash plow region of the run. The channel preferably presents a pair of generally co-planar, laterally spaced, internal brake surfaces defining a longitudinally extending slot therebetween. The assembly also includes a brake component having a pair of spaced brake shoe portions disposed in the channel adjacent corresponding ones of the internal brake surfaces. The brake component is rotatable in the channel in a direction for moving the brake shoe portions into frictional engagement with respective corresponding braking surfaces.

The assembly also includes force couple means operably coupled with the brake component and including a columnar element that is rigid with the brake component and disposed to extend through the slot. A pair of spaced connection points are provied on the columnar element and disposed externally of the channel. Also included is a support component comprising a platform for a window sash and an attachment means for operably interconnecting the support component and the columnar element at one of the connection points thereon. Additionally, the assembly comprises a balance spring having one of its ends attached to an end of the sash run means and a connector component interconnecting the other end of the spring to the other connection point on the columnar element. The arrangement of the assembly is such that the tension of the spring acting in one direction on its corresponding point of connection and the weight of the sash acting in the opposite direction on its corresponding point of attachment provide a torque which rotates the brake component in the braking direction.

DETAILED DESCRIPTION OF THE PREFERRED EMBODIMENTS

Figure 1:
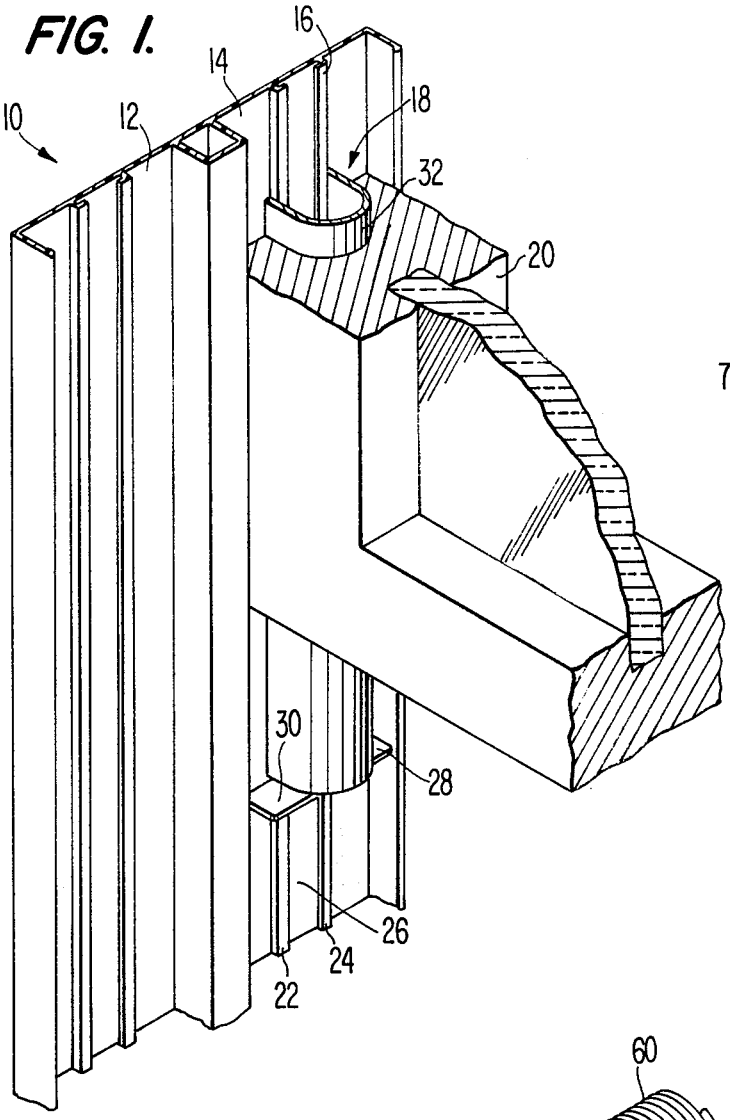
FIG. 1 is a partial perspective view illustrating a vertical sash run and the lower corner of a normally spring balanced window sash in a slightly raised position above its normal operating position where it would rest on the supporting elements therefore which are part of the brake mechanism of the present invention.

A vertical sash run element of the sort which is preferably utilized in conjunction with the present invention is illustrated in FIG. 1 where it is broadly designated by the reference numeral 10. Sash run element 10 includes a pair of side-by-side runs 12 and 14, each of which is provided with a generally C-shaped guidance and braking channel 16 disposed in the plow area 18 of the sash 20 when the entire window is assembled. Sash runs 12 and 14 are identical in all structural and operational details, and as is known to those skilled in the art to which the present invention pertains, in actual usage, one run is used for an upper sash while the other run is used for a lower sash. Since runs 12 and 14 and the respective brake mechanisms used therewith are identical, the invention will be described with reference only to run 14 and its respective brake mechanism.

Guide channel 16 extends vertically in sash run 14, and as can be seen in FIG. 1, channel 16 includes a pair of laterally spaced, vertically extending, co-planar flanges 22 and 24. A vertically extending slot 26 is presented between flanges 22 and 24. Window sash 20, only a portion of which is shown in FIG. 1, is illustrated in a slightly raised position relative to its normal position where it would rest on the wing portions 28 and 30 of a support platform 44 that is a part of a support component 40 which will be described in detail hereinbelow.

A generally U-shaped housing 32 having an external shape which generally corresponds with the internal shape of the plow region 18 of sash 20 is disposed in covering relationship relative to guide channel 16.

Although FIG. 1 is a fragmentary view of housing 32, it will be understood and appreciated by those of ordinary skill in the art to which the present invention pertains that housing 32 extends vertically in sash run 14 to the upper extremity of the latter. It will also be understood by those of ordinary skill in the art to which the present invention pertains, that a balance spring, such as the spring 60, for spring balancing sash 20 will be housed in housing 32 and will extend to the upper end of housing 32 where the same will be secured in a manner known to those skilled in the art and which does not form a part of the present invention.

Manifestly, sash run element 10 and its associated components, and housing 32, may preferably be constructed of an extrudable, thermoplastic material, such as vinyl. However, it should be appreciated that the housing may also be constructed of a bendable sheet metal material such as aluminum or steel. Moreover, the further details of the sash run element 10, or jamb liner as it is sometimes denominated by those skilled in the relevant art, are known, and to the extent that further detailed description is desired, the same is set forth in said co-pending application Ser. No. 881,927 and in another co-pending application assigned to the assignee of the present invention, Ser. No. 922,998, filed Oct. 24, 1986.

Figure 2:
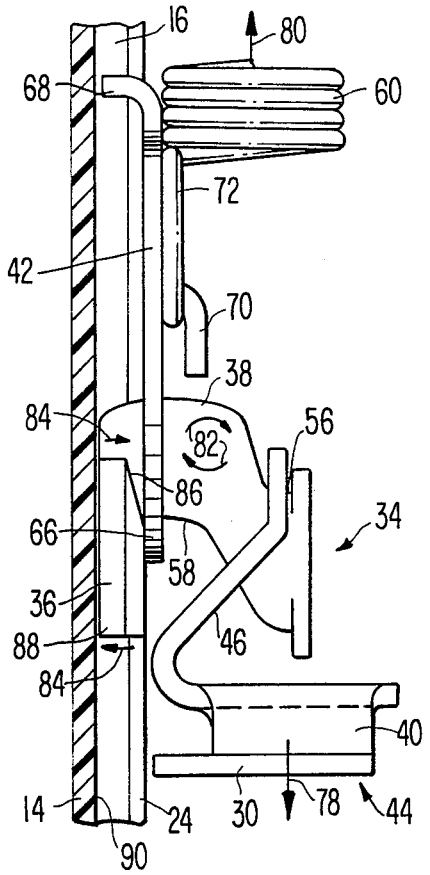
FIG. 2 is an enlarged, elevational view showing the brake mechanism of the present invention in its operating condition, portions of the sash run having been removed for improved clarity.
Figure 3:
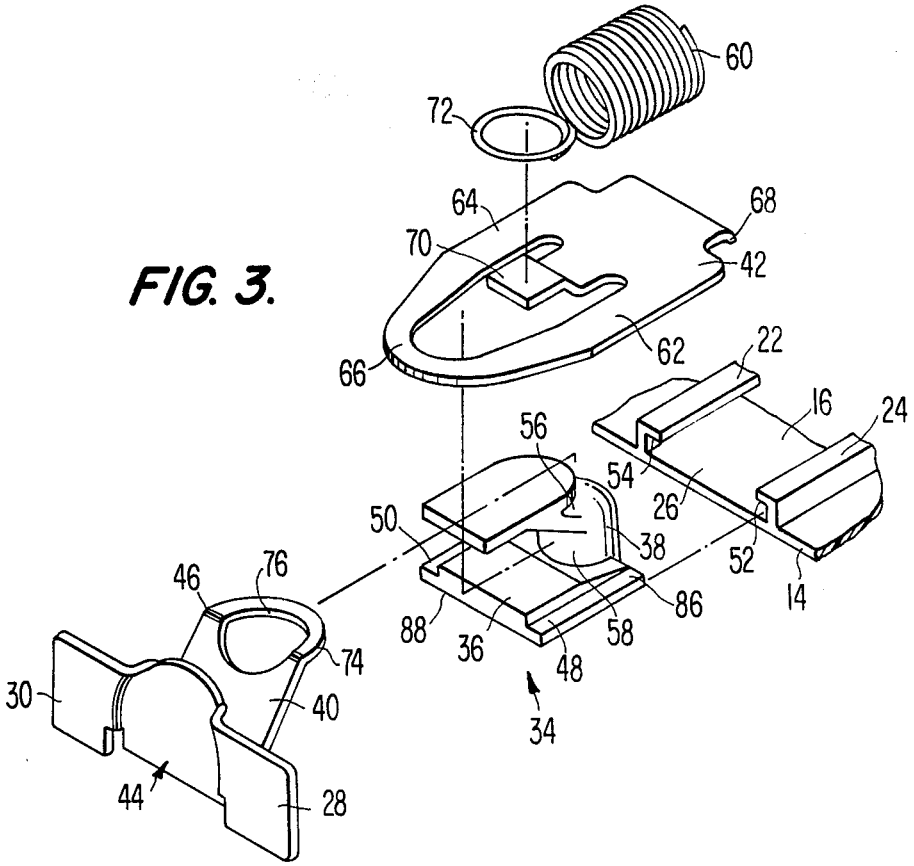
FIG. 3 is a perspective, exploded view showing the various components of the brake mechanism and illustrating the manner in which the same are assembled in accordance with the invention.

In its particularly preferred form, the brake mechanism of the present invention is illustrated in FIGS. 2 and 3 where the same is broadly designated by the reference numeral 34. Mechanism 34 includes a brake shoe component 36, a columnar element 38, a sash support component 40 and an elongated stabilizer element 42.

Support component 40 includes a platform 44 for supporting sash 20 during the operation of the mechanism of the present invention. As can particularly be seen viewing FIG. 3, platform 44 is configured to present wing portions 28 and 30 which are illustrated in their operational positions in FIG. 1. Support component 40 also includes mounting means in the form of an extension neck 46 for mounting support component 40 on columnar element 38.

Brake component 36 has a pair of laterally spaced brake shoe portions 48 and 50, as is particularly well illustrated in FIG. 3. With further reference to FIG. 3, it can be seen that channel 16 is configured to present a pair of generally co-planar, laterally spaced, internal brake surfaces 52 and 54 which, as can be seen, are the internal surfaces of flanges 24 and 22 respectively. And it is clear from FIG. 3 that when brake component 36 is inserted into channel 16, brake shoe portion 48 will move along brake surface 52 and brake shoe portion 50 will move along brake surface 54. In this regard, it can be seen from FIG. 3, that brake component 36 is configured to run inside channel 16 with its brake shoe portions adjacent inner brake surfaces 52 and 54 of channel 16.

As can be seen from FIGS. 2 and 3, columnar element 38 is integral and rigid with brake component 36, and in the preferred form of the invention, these components may be injection molded utilizing a thermoplastic material of the type which is conventionally used in mechanisms of the sort to which the present invention applies. As can be particularly well seen in FIG. 2, columnar element 38 is rigid with brake component 36 and is configured in such a manner that the same extends outwardly of channel 16 through slot 26. Element 38 provides a pair of laterally spaced, oppositely disposed load bearing connection points 56 and 58. The purpose of connection points 56 and 58 is reasonably apparent from FIG. 2; however, the exact function of these connection points will be further clarified hereinafter.

As can be seen viewing FIGS. 2 and 3, stabilizer element 42 is elongated, and in accordance with the present invention, the same is configured and is operable to inhibit lateral displacement of the balance spring 60 during operation of the brake mechanism. In this connection, stabilizer element 42 is configured to extend along the run in spanning relationship to slot 26. Element 42 includes wing areas 62 and 64 disposed to contact the outer surfaces of flanges 22 and 24 and slide along such surfaces during the operation of the mechanism. Stabilizer element 42 is configured to present connector means in the form of a U-shaped portion 66 configured to interengage and cooperate with connection point 58 on columnar element 38. In this regard, the internal configuration of portion 66 and the external surface of point 58 are rounded so that the same may be complimentarily mated when the mechanism is assembled.

Stabilizer element 42 further includes a tongue portion 68 having a lateral dimension which is just slightly smaller than the width of slot 26 whereby lateral movement of the stabilizer in a direction across slot 26 is substantially inhibited. Element 42 also includes spring attachment means in the form of a bent ear element 70. And as can best be seen in FIG. 3, the end loop 72 of spring 60 is bent downwardly into a position where it may be connected over bent ear 70. As will be appreciated by those skilled in the art to which the present invention pertains, stabilizer element 42 may preferably be constructed of a metal material and may be formed by a metal stamping process. In this same regard, support component 40 may also preferably be constructed of stamped and formed metal.

With reference again to support component 40 and in particular to its extension neck 46, it can be seen that the latter is provided with a rounded portion 74. Portion 74 has a hole therethrough presenting a rounded inner surface 76. Surface 76 is configured to conform to the outer shape of connection point 56, which is also rounded. Surface 76 and the outer surface of connection point 56 are thus configured to permit swinging of component 40 about the axis of surface 76 relative to columnar element 38. Moreover, as can be seen viewing FIG. 2, sufficient clearance is provided at connection point 56 to permit limited swinging of support component 40 about an axis which extends perpendicularly relative to the plane of FIG. 2, that is so as to permit clockwise and counterclockwise swinging of component 40 in the plane of FIG. 2. Thus, surface 76 of component 40 and the outer rounded surface of connection point 56 present structure providing freedom of rotational movement of platform 44, relative to the columnar element, about two generally perpendicular, generally horizontal axes.

Viewing FIG. 2, the weight of the window sash will pull downwardly on platform 44, and via extension neck 46, on connection point 56. This force is illustrated by the arrow identified by the reference numeral 78 in FIG. 2. Also, when the window sash is pulled downwardly against the tension of spring 60, the latter will act upwardly on ear element 70 and on connection point 58 through stabilizer element 42 in the direction illustrated by the arrow 80. The downward gravitational force acting at point 56 in combination with the upward spring tension force acting on point 58 result in the imposition of a force couple on columnar element 38 which will tend to rotate the latter in the direction of the arrows 82 in FIG. 2. At the same time, since brake component 36 is rigid with element 38, brake component 36 will also be rotated in the direction of the arrows 84 in FIG. 2. In this regard, it should be appreciated that the thickness and lateral dimensions of brake component 36 and brake shoe portions 48 and 50 are slightly less than the internal dimensions of channel 16, whereby component 36 is rotatable within channel 16. Moreover, when component 36 is rotated in the direction of arrows 84, at least the end portions 86 of brake shoe portions 48 and 50 will be forced into frictional engagement with braking surfaces 52 and 54 inside channel 16. At the same time, at the opposite end of component 36, at least the lower end portion 88 thereof will be moved into frictional engagement with the bottom surface 90 of channel 16. Thus, columnar element 38 and its spaced points of connection 56 and 58 present force couple means which is operably connected between spring 60 and sash 20 to convert the tension of spring 60 acting upwardly on connection point 58 and the weight of sash 20 acting downwardly on connection point 56 into a torque acting in a direction to rotate columnar element 38 and thereby brake component 36 in a clockwise direction viewing FIG. 2, so as to move brake shoe portions 48 and 50 into frictional engagement with surfaces 52 and 54.

Figure 4:
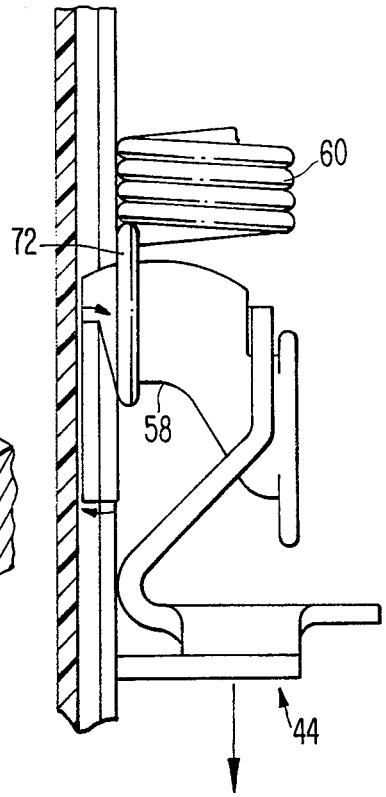
FIG. 4 is a view similar to FIG. 2 but illustrating another embodiment of the invention.
Figure 5:
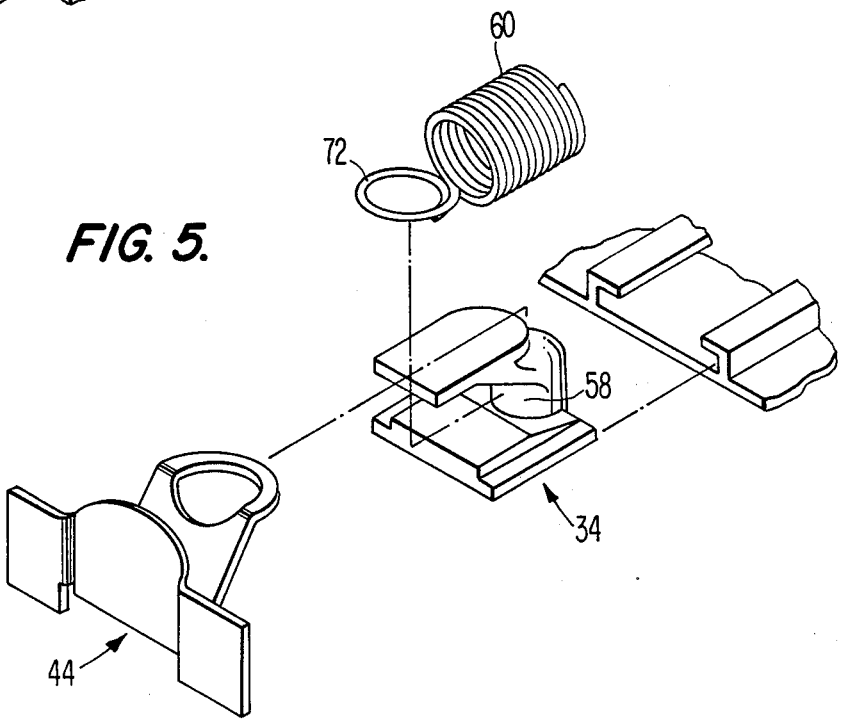
FIG. 5 is an exploded view similar to FIG. 3 and illustrating the components of the brake assembly of FIG. 4.

Another embodiment of the invention is presented in FIGS. 4 and 5 of the drawings. This embodiment is identical with the embodiment illustrated in FIGS. 2 and 3 except that the elongated stabilizer element 42 has been eliminated and the end loop 72 of spring 60 is attached directly to columnar element 38 at attachment point 58. This embodiment, while slightly less complicated than the preferred embodiment, since one component is eliminated, is slightly less desirable because the spring may move out of vertical alignment with channel 16 and impose a force element on columnar element 38 and brake component 36 which is not exactly in a vertical direction. This has been found to be disadvantageous in certain applications and may occasionally create minor design and operational problems. However, it has been found in most instances that the brake mechanism illustrated in FIGS. 4 and 5 is operable for its intended purposes.

Although the present invention has been described with particular reference to the specific embodiments shown in the drawings, it will be apparent to those of ordinary skill in the art to which the invention pertains, that there are many alternative arrangements which could be utilized as well in accordance with the present invention as set forth in the appended claims.

We claim:

1. A brake mechanism for applying sliding friction to retard movement of a spring balanced window sash running in a vertical sash run provided with a vertically extending braking surface, said mechanism comprising:

a brake component having a brake shoe portion adapted for movement along said surface as the sash moves vertically in the run, said component being rotatable in a direction for moving said brake shoe portion into frictional engagement with said braking surface; and force couple means operably coupled with said brake component and adapted to be operably connected between a balance spring and said window sash for converting the tension of the spring acting upwardly and the weight of the window acting downwardly into a torque acting on said brake component for rotating the latter in said direction.

2. A brake mechanism as set forth in claim 1 wherein said force couple means comprises a columnar element rigid with said brake component and having spaced points of connection thereon for load bearing connection to said spring and said sash respectively.

3. A brake mechanism as set forth in claim 2 wherein said brake shoe portion is configured for running inside a guide channel, said braking surface comprising an inner surface of said channel.

4. A brake mechanism as set forth in claim 2 wherein said brake component has a pair of spaced brake shoe portions configured for running inside a generally C-shaped guide channel presenting a pair of horizontally spaced, vertically extending braking surfaces defining a vertical slot therebetween, said portions interacting with respective corresponding surfaces, said columnar element being configured to extend through said slot with said points of connection disposed externally of the channel.

5. A brake mechanism as set forth in claim 4 wherein said channel has a pair of horizontally spaced, longitudinally extending outer surfaces disposed on respective opposite sides of the slot, said mechanism including a generally planar, elongated stabilizer element for interconnecting the spring and its corresponding connection point on the columnar element, said stabilizer element being configured to span the slot and slide along said surfaces during operation of the mechanism to inhibit lateral displacement of the spring when the brake component rotates.

6. A brake mechanism as set forth in claim 5 wherein said stabilizer element includes a tongue portion which protrudes through the slot and into the channel between said surfaces, said tongue portion having a lateral dimension which is slightly less than the width of the slot to thereby inhibit lateral movement of the element.

7. A brake mechanism as set forth in claim 2 wherein is included a support component comprising a platform for the sash and means for mounting the support component on the columnar element at the corresponding connection point thereon.

8. A brake mechanism as set forth in claim 7 wherein said mounting means includes structure providing freedom for rotational movement of the platform relative to the columnar element about two generally perpendicular, generally horizontal axes.

9. A brake mechanism as set forth in claims 2, 7 or 8 wherein is included connector means for connecting the spring to its corresponding point of connection on the columnar element.

10. A brake mechanism as set forth in claim 9 wherein said connector means comprises an elongated stabilizer element for interconnecting the spring and its corresponding connection point on the columnar element, said stabilizer element being operable to inhibit lateral displacement of the spring during rotation of the brake component.

11. A brake mechanism as set forth in claim 10 wherein said stabilizer element has a spring attachment means at one end thereof and connector means at its other end configured for connection to the connection point for the spring on the columnar element.

12. A composite jamb liner and balance spring assembly comprising:

means defining an elongated sash run provided with a longitudinally extending, generally C-shaped guide channel disposed in the sash plow region of the run, said channel having a pair of generally coplanar, laterally spaced, internal brake surfaces defining a longitudinally extending slot therebetween;

a brake component having a pair of spaced brake shoe portions disposed in said channel adjacent respective ones of said internal brake surfaces, said brake component being rotatable in the channel in a direction for moving said portions into frictional engagement with said respective braking surfaces;

force couple means operably coupled with said brake component and including a columnar element that is rigid with the brake component and disposed to extend through said slot, there being a pair of spaced connection points on the columnar element and disposed externally of the channel;

a support component including a platform for a window sash and attachment means for operably interconnecting the support component and the columnar element at one of said connection points;

a balance spring having one of its ends attached to an end of said sash run means; and a connector component interconnecting the other end of the spring to the other connection point on said columnar element, the arrangement being such that the tension of the spring acting in one direction on its corresponding point of connection and the weight of the sash acting in the opposite direction on the corresponding point of attachment of the support component provide a torque for rotating the brake component in said direction.

13. A composite jamb liner and balance spring assembly comprising:

means defining an elongated sash run provided with a longitudinally extending, generally C-shaped guide channel disposed in the sash plow region of the run, said channel having a pair of generally co-planer, laterally spaced flanges defining a longitudinally extending slot therebetween and presenting a pair of laterally spaced internal brake surfaces and a pair of laterally spaced external guide surfaces;

a brake component having a pair of spaced brake shoe portions disposed in said channel adjacent respective ones of said internal brakes surfaces, said brake component being rotatable in the channel in a direction for moving said portions into frictional engagement with said respective braking surfaces;

force couple means operably coupled with said brake component and including a columnar element that is rigid with the brake component and disposed to extend through said slot, there being a pair of spaced connection points on the columnar element and disposed externally of the channel;

a support component including a platform for a window sash and attachment means for operably interconnecting the support component and the columnar element at one of said connection points, said attachment means and the corresponding connection point on the columnar element being configured and arranged to provide freedom for rotational movement of the platform relative to the columnar element about two generally perpendicular, generally horizontal axes;

a balance spring having one of its ends attached to an end of said sash run means; and a connector component comprising an elongated stabilizer element interconnecting the other end of the spring and the other connection point on said columnar element, said stabilizer element being configured to span the slot and slide along said outer surfaces of the channel during operation of the mechanism to inhibit lateral displacement of the spring when the brake component rotates, the arrangement of the force couple means being such that the tension of the spring acting in one direction on its corresponding point of connection and the weight of the sash acting in the opposite direction on the corresponding point of attachment of the support component provide a torque for rotating the brake component in said direction.

* * * * *